US006057864A

United States Patent [19]

Wen

[11] Patent Number: 6,057,864

[45] Date of Patent: May 2, 2000

[54] IMAGE PRODUCING APPARATUS FOR UNIFORM MICROFLUIDIC PRINTING

[75] Inventor: Xin Wen, Rochester, N.Y.

[73] Assignee: Eastman Kodak Company, Rochester, N.Y.

[21] Appl. No.: 08/868,100

[22] Filed: Jun. 3, 1997

[51] Int. Cl.[7] ..... B41J 2/005

[52] U.S. Cl. ..... 346/140.1; 347/43

[58] Field of Search ..... 346/140.1; 347/43, 347/6, 7, 14

[56] References Cited

U.S. PATENT DOCUMENTS 4,485,387 11/1984 Drumheller ..... 346/140.1
5,745,128 4/1998 Lam et al. ..... 346/140.1
5,771,810 6/1998 Wolcott ..... 346/140.1
5,841,955 11/1998 Wang ..... 347/6

*Primary Examiner*—N. Le
*Assistant Examiner*—Lamson D. Ngueyn
*Attorney, Agent, or Firm*—Raymond L. Owens

[57] ABSTRACT

An image producing apparatus which can produce a plurality of ink pixels on a display such as a receiver medium is disclosed. The apparatus includes a plurality of ink delivery chambers; a plurality of microfluidic pumps, each associated with a particular ink delivery chamber; and a computer for producing pump parameters to compensate for variabilities in each ink delivery chamber. The apparatus further is responsive to the pump parameters for delivering the correct amount of ink into each ink delivery chamber which is compensated for variabilities in each delivery chamber.

5 Claims, 6 Drawing Sheets

| Pixel Number | 11 | 12 | 13 | . . . . . | ij | . . . . . |
|---|---|---|---|---|---|---|
| Yellow ink | $\sigma_{11Y}$ | $\sigma_{12Y}$ | $\sigma_{13Y}$ | . | $\sigma_{ijY}$ | . |
| Magenta ink | $\sigma_{11M}$ | $\sigma_{12M}$ | $\sigma_{13M}$ | . | $\sigma_{ijM}$ | . |
| Cyan ink | $\sigma_{11C}$ | $\sigma_{12C}$ | $\sigma_{13C}$ | . | $\sigma_{ijC}$ | . |
| Black ink | $\sigma_{11K}$ | $\sigma_{12K}$ | $\sigma_{13K}$ | . | $\sigma_{ijK}$ | . |
| Clearless ink | $\sigma_{11Cl}$ | $\sigma_{12Cl}$ | $\sigma_{13Cl}$ | . | $\sigma_{ijCl}$ | . |
| . . . . | . . . . | . . . . | . . . . | . | . . . . | . |

450

FIG. 5

IMAGE PRODUCING APPARATUS FOR UNIFORM MICROFLUIDIC PRINTING

CROSS REFERENCE TO RELATED APPLICATIONS

Reference is made to commonly assigned U.S. patent application Ser. No. 08/868,104 filed Jun. 3, 1997 entitled "Image Producing Apparatus for Microfluidic Printing" filed concurrently herewith by Wen, and U.S. patent application Ser. No. 08/868,426 entitled "Continuous Tone Microfluidic Printing" by DeBoer, Fassler, and Wen, assigned to the assignee of the present invention. The disclosure of these related applications is incorporated herein by reference.

FIELD OF THE INVENTION

The present invention relates to an image producing apparatus for printing digital images by microfluidic pumping of colored inks.

BACKGROUND OF THE INVENTION

Microfluidic pumping and dispensing of liquid chemical reagents is the subject of three U.S. Pat. Nos. 5,585,069; 5,593,838; and 5,603,351; all assigned to the David Sarnoff Research Center, Inc. and hereby incorporated by reference. The system uses an array of micron sized reservoirs, with connecting microchannels and reaction cells etched into a substrate. Electrokinetic pumps include electrically activated electrodes within the capillary microchannels provide the propulsive forces to move the liquid reagents within the system. The electrokinetic pump, which is also known as an electroosmotic pump, has been disclosed by Dasgupta et al, see "Electroosmosis: A Reliable Fluid Propulsion System for Flow Injection Analyses", Anal. Chem. 66, pp 1792–1798 (1994). The chemical reagent solutions are pumped from a reservoir, mixed in controlled amounts, and then pumped into a bottom array of reaction cells. The array could be decoupled from the assembly and removed for incubation or analysis. When used as a printing device, the chemical reagent solutions are replaced by dispersions of cyan, magenta, and yellow pigment, and the array of reaction cells could be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or reproduction, of the original scene.

One problem known to printing is an image artifact called printing non-uniformities. Printing non-uniformities can be produced by different causes. For example, many printing apparatus transport a receiver relative to the print head during printing. Non-uniform mechanical movement in the motors or gears often produces "banding" type of printing non-uniformities. These mechanical transport related printing non-uniformities are overcome by above referenced, commonly assigned U.S. Patent Applications that disclosed microfluidic printing apparatus comprising two-dimensional array of microfluidic mixing chambers. An image area is formed on a receiver when the receiver is in contact with the printing apparatus. The ink delivery chambers are not required to move relative to the receiver during the ink transfer.

Another cause for printing non-uniformities is the variabilities between the ink delivery means of different pixels. For a microfluidic printing apparatus, the variabilities between the ink delivery means such as ink mixing chambers can be the variabilities in the volumes of the ink mixing chambers, the diameter of the ink supply channels, or the pumping efficiencies of the electrokinetic pumps. These variabilities are often introduced in the micro-fabrication process of the microfluidic printing apparatus. Variabilities between ink mixing chambers result in pixel-wise variabilities in the amounts of ink delivered even if a uniform input image is printed. The variability problem is particularly severe for microfluidic printing apparatus comprising a large number of mixing chambers in a two-dimensional array because it is usually more difficult to control variabilities in the micro-fabrication process involving a large number of mixing chambers.

SUMMARY OF THE INVENTION

An object of the present invention is to provide high-quality prints by microfluidic printing.

Another object of the present invention is to reduce non-uniformities in microfluidic printing.

Another object of the present invention is to compensate for variabilities among pixels in the microfluidic printing.

Still another object of the present invention is to provide a robust microfluidic printing apparatus.

These objects are achieved by an improved image producing apparatus which can produce a plurality of ink pixels on a display such as a receiver medium, comprising:

a) a plurality of ink delivery chambers;

b) a plurality of microfluidic pumps, each associated with a particular ink delivery chamber;

c) computing means for producing pump parameters to compensate for variabilities in each ink delivery chamber; and d) means responsive to the pump parameters for delivering the correct amount of ink into each ink delivery chamber which is compensated for variabilities in each delivery chamber.

ADVANTAGES

One feature of the present invention is that it provides high quality printed images for imperfectly fabricated microfluidic printing apparatus.

Another feature of this invention is that it provides an improved image producing apparatus for microfluidic printing.

Another feature of the present invention is that the pump parameters are calibrated differently against input image code values for different pixels.

Another feature of this invention is that it is applicable to continuous-tone or bi-modal microfluidic printing.

Another feature of this invention is that it is applicable to colored and monochromatic printing.

BRIEF DESCRIPTION OF THE DRAWINGS

FIG. 5 is a representative pump parameter correction table for use in the flow chart in FIG. 4B.

DETAILED DESCRIPTION OF THE INVENTION

The present invention is described in relation to a printer that pumps inks using microfluidic pumps. The output images produced by such a printer can be bi-modal or continuous tone. The images can include continuous-tone images recorded from nature, computer generated images, graphic images, line art, text images, and the like. Throughout the present application, it will be understood that the term "colorless ink" refers to colorless or white fluids that do not absorb visible light when the colorless ink is transferred to a receiver. Although a particular receiver is described for receiving ink to produce an image, it will also be understood that the term receiver includes any type of display media for receiving and producing an image, including the receivers disclosed in the above referenced U.S. patent application Ser. No. 08/868,104 filed Jun. 3, 1997 entitled "Image Producing Apparatus for Microfluidic Printing" filed concurrently herewith by Wen, and U.S. patent application Ser. No. 08/868,426 entitled "Continuous Tone Microfluidic Printing" by DeBoer, Fassler, and Wen, assigned to the assignee of the present invention. The disclosure of these related applications is incorporated herein by reference.

Figure 1:
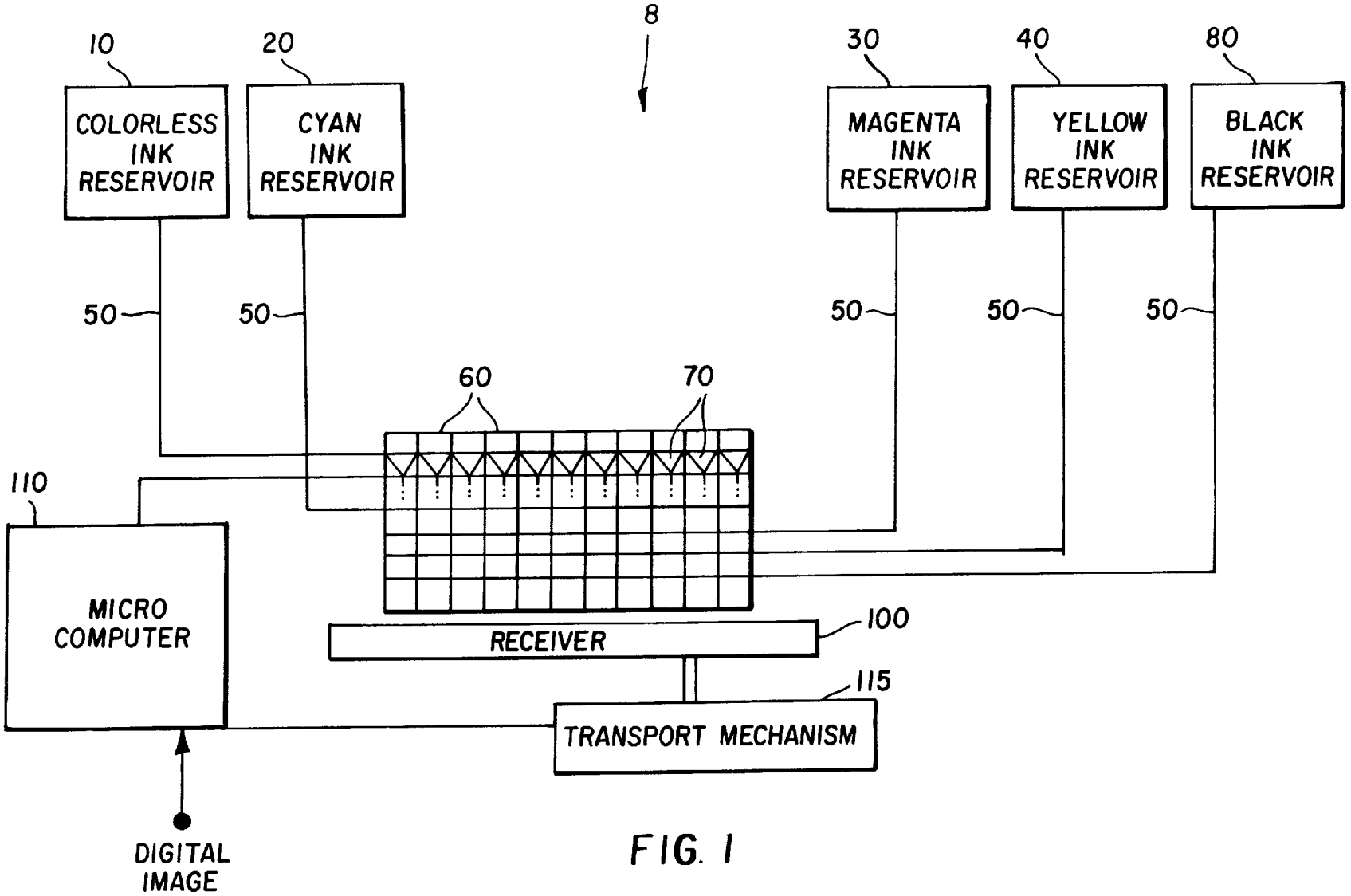
FIG. 1 is a partial schematic view showing a printing apparatus for pumping, mixing and printing pixels of ink onto a receiver.

Referring to FIG. 1, a schematic diagram is shown of a printing apparatus 8 in accordance with the present invention. Reservoirs 10, 20, 30, and 40 are respectively provided for holding colorless ink, cyan ink, magenta ink, and yellow ink. An optional reservoir 80 is shown for black ink. Microchannel capillaries 50 respectively connected to each of the reservoirs conduct ink from the corresponding reservoir to an array of ink mixing chambers 60. In the present invention, the ink mixing chambers 60 deliver the ink directly to a receiver; however, other types of ink delivery arrangements can be used such as microfluidic channels, and so when the word chamber is described, it will be understood to include those arrangements. The colored inks are delivered to ink mixing chambers 60 by electrokinetic pumps 70. The amount of each color ink is controlled by microcomputer 110 according to the input digital image. For clarity of illustration, only one electrokinetic pump 70 is shown for the colorless ink channel. Similar pumps are used for the other color channels, but these are omitted from the figure for clarity. Finally, a receiver 100 is transported by a transport mechanism 115 to come in contact with the microfluidic printing apparatus. The receiver 100 accepts the ink and thereby produce the print.

Figure 2:
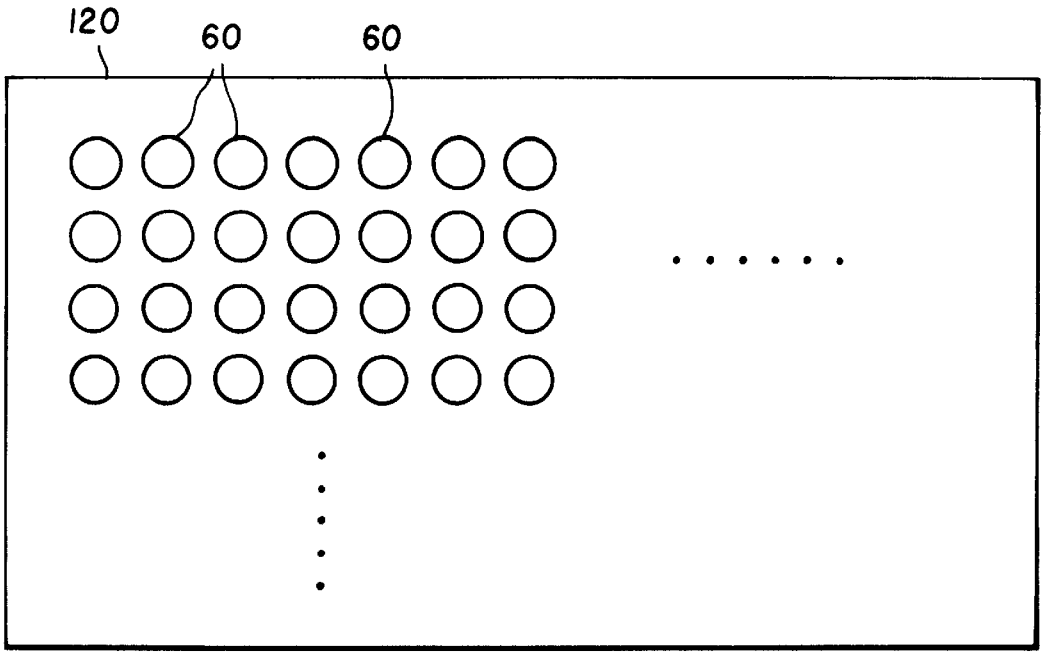
FIG. 2 is a top view of the mixing chambers in the apparatus of FIG. 1 described in the present invention.

FIG. 2 depicts a top view of an arrangement of mixing chambers 60 shown in FIG. 1. Each ink mixing chamber 60 is capable of producing a mixture of inks of different colors having any color saturation, hue, and lightness within the color gamut provided by the set of inks used in the apparatus. This results in a continuous tone photographic quality image on the receiver 100. As shown in FIG. 1, there is provided a microcomputer 110 which receives a digital image. The digital image includes a number of digital pixels which represents a continuous tone colored image. The microcomputer 110 is connected to the electrokinetic pump 70 and controls their operation. More particularly, it causes the pump to meter the correct amount of inks into each of the ink mixing chambers 60 to provide both the correct hue and tone scale for each colored pixel. Another function of the microcomputer is to arrange the array of image pixels in the proper order so the image will be right reading to the viewer. The microcomputer includes a matrix, or look-up table, which is determined experimentally, of all the colors which can be achieved by varying the mixture of inks. When data for a particularly pixel (8 bits per color plane) are inputted, the output from the look-up table will control signals to the electrokinetic pumps to meter out the correct amount of each ink. Details of the image processing and the calculations of the pump parameters will be described below. Also provided is a transport mechanism 115 which is adapted to move the receiver 100 into and out of engagement with the ink mixing chambers 60 under the control of the microcomputer 110. After the ink mixing chambers 60 have the appropriate amount of mixed ink, the microcomputer 110 signals the transport mechanism 115 to move the receiver 100 into engagement with the ink mixing chambers 60 for ink transfer.

The colored inks used in this invention are dispersions of colorants in common solvents. Examples of such inks are found is U.S. Pat. No. 5,611,847 by Gustina, Santilli, and Bugner. Inks are also be found in the following commonly assigned U.S. patent application Ser. No. 08/699,955 filed Aug. 20, 1996 entitled "Cyan and Magenta Pigment Set"; U.S. patent application Ser. No. 08/699,962 filed Aug. 20, 1996 entitled "Magenta Ink Jet Pigment Set"; U.S. patent application Ser. No. 08/699,963 filed Aug. 20, 1996 entitled "Cyan Ink Jet Pigment Set", all by McInerney, Oldfield, Bugner, Bermel, and Santilli; and in U.S. patent application Ser. No. 08/790,131 filed Jan. 29, 1997 entitled "Heat Transferring Inkjet Ink Images" by Bishop, Simons, and Brick; and U.S. patent application Ser. No. 08/764,379 filed Dec. 13, 1996 entitled "Pigmented Inkjet Inks Containing Phosphated Ester Derivatives" by Martin, the disclosures of which are incorporated by reference herein. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention can take a number of different forms, which will suggest themselves to those skilled in the art. If the colored inks are water soluble, then the colorless ink can indeed be water.

The microchannel capillaries, ink mixing chambers 60 and electrokinetic pumps are described in the patents listed above.

The receiver 100 can be common paper having sufficient fibers to provide a capillary force to draw the ink from the mixing chambers into the paper. Synthetic papers can also be used. The receiver can have a coated layer of polymer which has a strong affinity, or mordanting effect for the inks. For example, if a water based ink is used, the colorless ink can be water, which also acts as a solvent, and a layer of gelatin will provide an absorbing layer for these mixed inks. In a preferred embodiment of the invention, an exemplary receiver is disclosed in commonly assigned U.S. Pat. No. 5,605,750 to Romano et al.

The typical printing operation in the present invention involves the following steps. First the microcomputer 110 receives a digital image or digital image file consisting of electronic signals in which the color code values are characterized by bit depths of an essentially continuous tone image, for example, 8 bits per color per pixel. Based on the color code values at each pixel in the digital image, which define the lightness, hue, and color saturation at the pixel, the microcomputer 110 operates the electrokinetic pumps to mix the appropriate amount of colored inks and colorless inks in the array of ink mixing chambers 60. Stated differently, the corresponding mixed inks in each chamber 60 are in an amount corresponding to the code values for a digital colored pixel. Details of the pump parameter calculations will be described below. The mixture of inks, which has the same Lightness, hue and color saturation as the corresponding pixel of the original image being printed, is held in the mixing chamber by the surface tension of the ink. The receiver 100 is subsequently placed by the transport mechanism 115 under the control of the microcomputer 110 in contact with the ink meniscus of the ink mixing chamber 60 within the printer front plate 120. The mixture of inks contained in the mixing chamber 60 is then drawn into the receiver by the capillary force of the paper fibers, or by the absorbing or mordanting force of the polymeric layer coated on the receiver. The receiver is peeled away from the ink mixing chambers in the printer front plate immediately after the time required to reach the full density of the print. The receiver cannot be left in contact with the front plate for too long a time or the density of the print will be higher than desired. One important advantage of the present invention is the reduction of the printing image defects that commonly occur when the cyan, magenta, and yellow inks are printed in separate operations. Misregistration of the apparatus often leads to visible misregistration of the color planes being printed. In this invention, all the color planes are printed simultaneously, thus eliminating such misregistration.

Ink from the black ink reservoir 80 can be included in the colored in mixtures to improve the density of dark areas of the print, or can be used alone to print text, or line art, if such is included in the image being printed.

Figure 3:
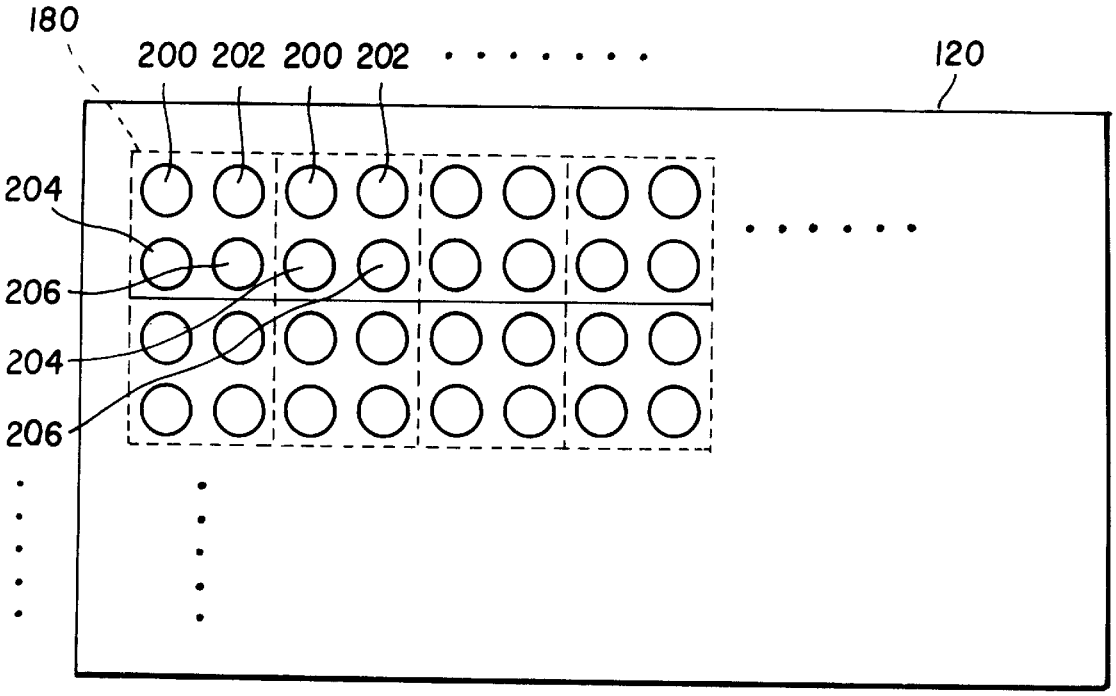
FIG. 3 is a top view of an alternate pattern of mixing chambers which can be used in the microfluidic printing apparatus of FIG. 1.

In an alternate scheme for printing with this invention, shown in FIG. 3, the ink mixing chambers 60 are divided into four groups cyan ink mixing chamber 200; magenta ink mixing chamber 202; yellow ink mixing chamber 204; and black ink mixing chamber 206. Each chamber is connected only to the respective ink color reservoir and to the colorless ink reservoir 10. For example, the cyan ink mixing chamber 200 is connected to the cyan ink reservoir and the colorless ink reservoir so that cyan inks can be mixed to any desired lightness. When the inks are transferred to the receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Within the microcomputer 110, there is an image producing algorithm which will be explained with reference to the flow chart of FIGS. 4A and 4B. The image file, which can be applied an input to microcomputer 110, is stored in an electronic memory block 300. Alternatively, the image file can be produced by the microcomputer 110 or provided as an input from a magnetic disk, a compact disk (CD), a memory card, a magnetic tape, a digital camera, a print scanner, or a film scanner, and the like. The image file can exist in many formats such as a page-description language or a bitmap format such as Postscript, JPEG, TIF, Photoshop, and so on. Next, the image file is processed, in block 305, which can include the following operations: decoding; decompression; rotation; resizing; coordinate transformation; mirror-image transformation (for printing on receiver media); tone scale adjustment; color management; multilevel halftoning (or multitoning); code-value conversion; rasterization; and other operations. The output image file from block 305 includes a plurality of spatial pixels described by color code values with the pixels corresponding to ink mixing chambers 60 (FIG. 2) or full color pixel 180 (FIG. 3) in the microfluidic printing system 8 (FIG. 1).

Figure 4A:
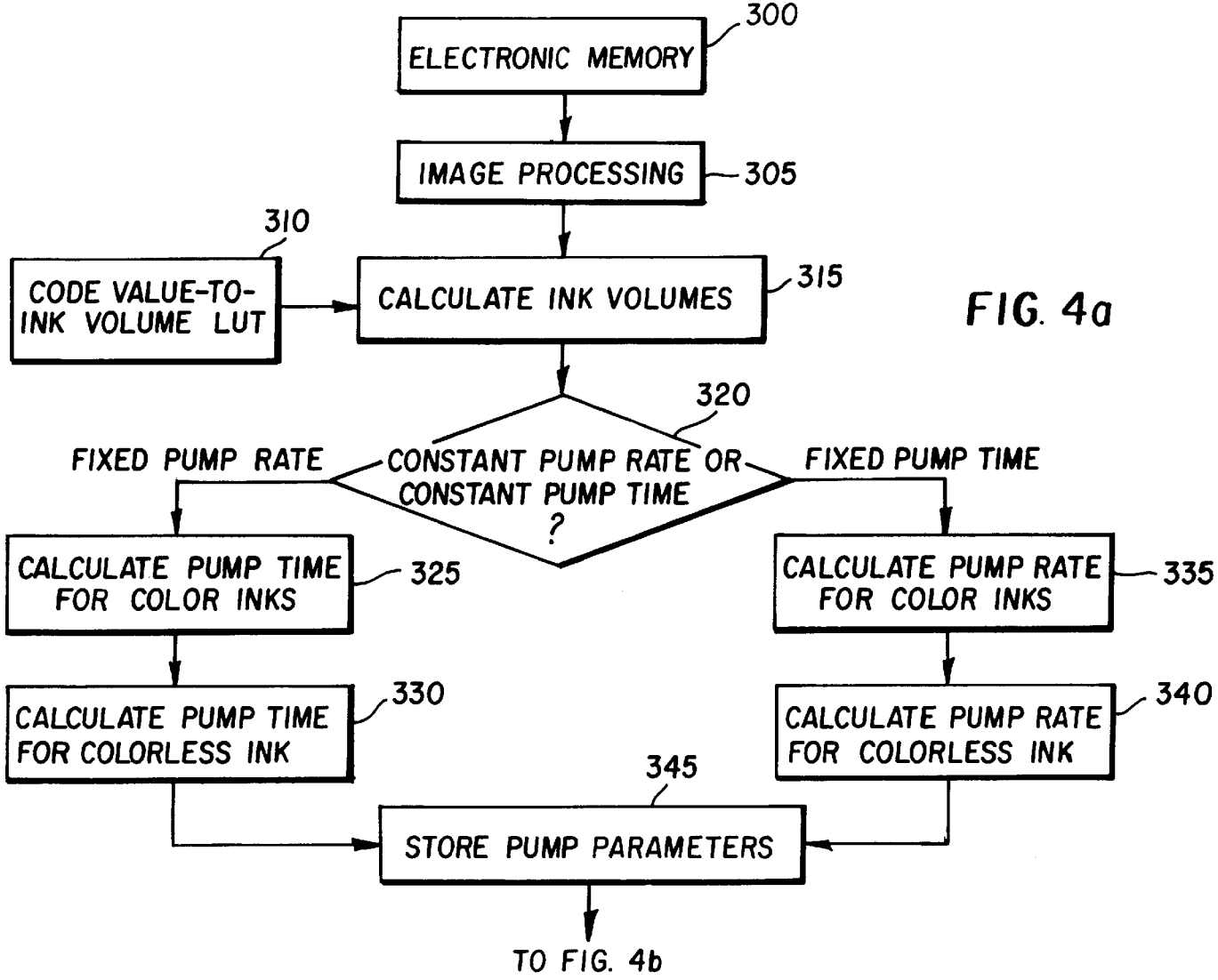
FIG. 4A is a flow diagram used in the improved image producing apparatus used in FIG. 1
Figure 4B:
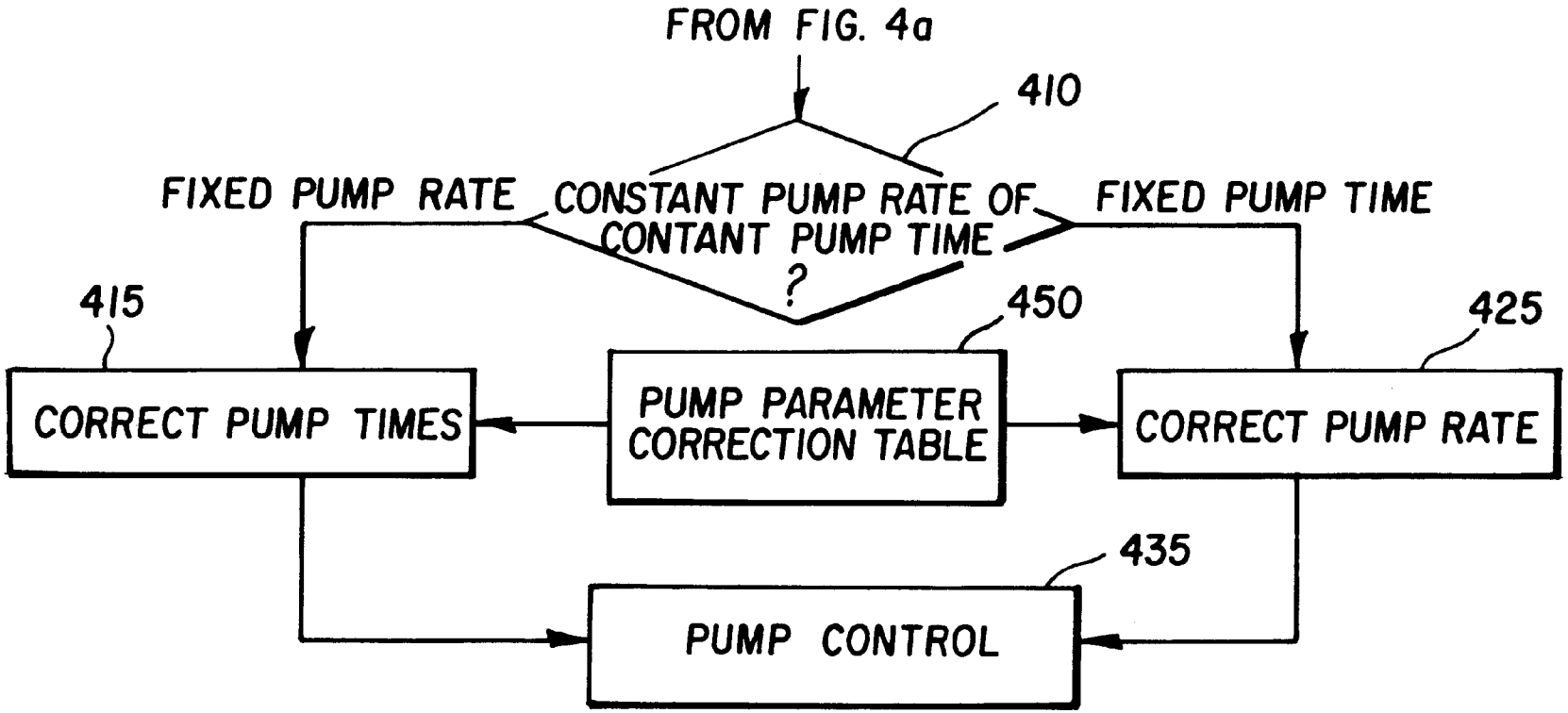
FIG. 4B is a continuation of the flow chart of FIG. 4A.

In FIG. 4A, in block 315, the ink volumes required to be pumped for the inks are calculated according to the code values for each spatial pixel with the assistance of a code value-to-ink volume look-up table (LUT) in block 310. Details about block 310 and methods for producing block 310 are disclosed in the above referenced and commonly assigned U.S. Patent Applications. A question as shown in block 320 is then asked whether the inks will be pumped at constant pump rate or constant pump time to the ink mixing chambers 60. If a constant pump rate is selected, the pump times are calculated for each colored ink connected to every ink mixing chamber 60 in block 325. For example, for ink volumes Vy, Vm, Vc required for yellow, magenta and cyan inks in an ink mixing chamber 60, the pump times are obtained by ty=Vy/Ry, tm=Vm/Rm, and tc=Vc/Rc, in which Ry, Rm, Rc are the pump rates for the yellow, magenta and cyan inks. Next, in block 330, the pump time for the colorless ink is determined. The volume of the colorless ink Vcl=Vtotal−Vy−Vm−Vc, which is normally kept at a constant for uniform ink transfer to the receiver. The pump time for the colorless ink is therefore tcl=Vcl/Rcl. If constant pump time is selected from the block 320, then the pump rates are calculated in block 335 for each colored ink connected to each ink mixing chamber 60. For example, for ink volumes Vy, Vm, Vc required for yellow, magenta and cyan inks in an ink mixing chamber 60, the pump rates are obtained by Ry=Vy/t, Rm=Vm/t, and Rc=Vc/t in which Ry, Rm, Rc are the pump rates for the yellow, magenta and cyan inks and t is the fixed pump time. Next, in block 340, the pump rate for the colorless ink is determined. The volume of the colorless ink Vcl=Vtotal−Vy−Vm−Vc, which is normally kept at a constant for uniform ink transfer to the receiver media. The pump time for the colorless ink is therefore Rcl=Vcl/t. In general, pump times and pump rates can both be varied in a microfluidic printing system and can be included in the image processing algorithm.

The pump parameters such as pump times and pump rates are stored in electronic memory in microcomputer 110 in block 345. For example, at pixel (ij) with i being the row number and j being the column number (FIGS. 2 and 3), the pump times for yellow, magenta and cyan inks are $t_{ijy}$, $t_{ijm}$, and $t_{ijc}$ and pump rates are $R_{ijy}$, $R_{ijm}$, and $R_{ijc}$ respectively. Up to Block 345, the pump parameters at each pixel location have been determined by the code values of the image file at that pixel location, and the code value-to-ink volume look-up table (block 310) used is equally applied to all pixels in the microfluidic printing apparatus.

Detailed steps of compensating variabilities between ink chambers are now described. Now referring to FIG. 4B, in block 410, a question is asked whether inks will be pumped at constant pump rate or constant pump time to the ink mixing chambers 60. If a constant pump rate is selected, the pump times are corrected for each ink connected to every ink mixing chamber 60 in block 415 using the pump parameter correction table in block 450. The corrected pump times at pixel (ij) are obtained by $t_{ijy}'=t_{ijy}(1+\sigma_{ijy})$, $t_{ijm}'=t_{ijm}(1+\sigma_{ijm})$, $t_{ijc}'=t_{ijc}(1+\sigma_{ijc})$ and $t_{ijcl}'=t_{ijcl}(1+\sigma_{ijcl})$ in which $\sigma_{ijy}$, $\sigma_{ijm}$, $\sigma_{ijc}$ and $\sigma_{ijcl}$ are the pump parameter correction values for the yellow, magenta, cyan and colorless inks at pixel (ij). A schematic illustration of the pump parameter correction values for each color ink at each pixel in block 450 is illustrated in FIG. 5.

If a constant pump time is selected in response to the question in block 410, the pump rates are corrected for colored inks for each pixel in block 425 using the pump parameter correction table in block 450. The corrected pump rates at pixel (ij) are obtained by $R_{ijy}'=R_{ijy}(1+\sigma_{ijy})$, $R_{ijm}'=R_{ijm}(1+\sigma_{ijm})$, $R_{ijc}'=R_{ijc}(1+\sigma_{ijc})$ and $R_{ijcl}'=R_{ijcl}(1+\sigma_{ijcl})$ in which $\sigma_{ijy}$, $\sigma_{ijm}$, $\sigma_{ijc}$, and $\sigma_{ijcl}$ are, as above, the pump parameter correction values at pixel (ij) stored in the table as shown in FIG. 5.

Next, the microcomputer 110 delivers the pump parameters of the different inks to each ink mixing chamber 60 to the pump control in block 435. During the pumping operation, the pump rates are set by the bias voltage between the electrodes in the microfluidic pumps as described in the above referenced patents and reference therein. The pump times correspond to the duration of the on-time for the microfluidic pumps, which is set by the number of clock cycles.

Figure 6:
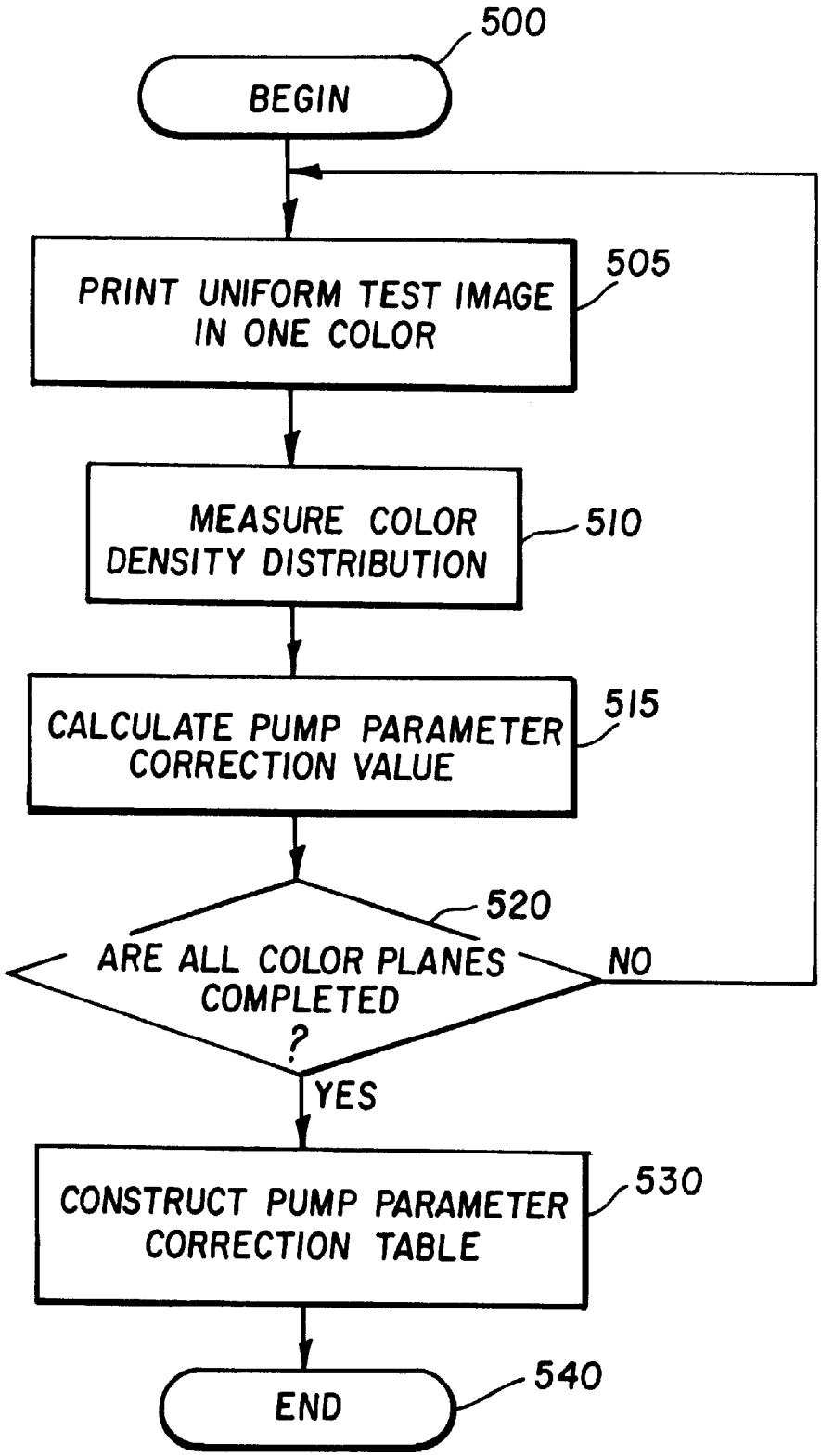
FIG. 6 is a flow chart showing a representative flow diagram for constructing the pump parameter correction table of FIG. 5.

Detailed steps of producing the pump parameter correction table of block 450 as shown in FIG. 5 is now described. As shown in FIG. 6, a flow chart for producing the pump parameter correction table of block 450 begins with block 500. An uniform test image is printed by the microfluidic printing apparatus using one of the yellow, magenta, cyan or black inks in block 505. The color densities of each pixel on the printed image are measured by a micro-densitometer in block 510. For reducing statistical errors, the same uniform test image is printed multiple times. The deviations of the mean color densities over the multiple prints at each pixel from the average color density in the whole image over the multiple prints represent the printing variability at that pixel. Next in block 515 the correction values for the pump parameters are calculated for the purpose of reducing the density variations between pixels. As an example, for a pixel that prints less than the average density value, the pump time and pump rate need to be increased by the same percentage of density deviation at the pixel compared to the average density value. The correction values for the pump parameters can be calculated using more elaborate functions. Next a question is asked whether all color planes are completed in block 520. If not, the same procedure is repeated from block 505 until all color planes are completed. The pump parameter correction table is then constructed in block 530 using the percentage changes required for the pump times or pump rates for each color ink at each pixel. An example of the layout of the table is shown in FIG. 5. The procedure ends in block 540.

The present invention provides high quality print images by microfluidic pumps even if the ink delivery chambers are fabricated with certain variabilities. The invention thus represents a more robust image producing apparatus. The invention apparatus also produces images very efficiently by means of pre-calibrated look-up tables. The invention apparatus is also applicable to different types of images, and to both color and monochromatic images.

It is also understood the techniques taught in the present invention and the above referenced and commonly assigned U.S. Application by the same author are also applicable to non-printing apparatus involving electrokinetic pumps and microfluidic devices.

The invention has been described in detail with particular reference to certain preferred embodiments thereof, but it will be understood that variations and modifications can be effected within the spirit and scope of the invention.

PARTS LIST

8 microfluidic printing system
10 colorless ink reservoir
20 cyan ink reservoir
30 magenta ink reservoir
40 yellow ink reservoir
50 microchannel capillaries
60 ink mixing chambers
70 electrokinetic pumps
80 black ink reservoir
100 receiver
110 microcomputer
115 transport mechanism
120 printer front plate
180 full color pixel
200 cyan ink mixing chamber
202 magenta ink mixing chamber
204 yellow ink mixing chamber
206 black ink mixing chamber
300 electronic memory block
305 image processing block
310 code value to ink volume look-up table block
315 calculating ink volume block
320 constant pump rate or constant pump time?
325 calculate pump time for colored inks
330 calculate pump time for colorless inks
335 calculate pump rate for colored inks
340 calculate pump rate for colorless inks
345 store pump parameters
410 constant pump rate or constant pump time?
415 correct pump times
425 correct pump rates
435 pump control
450 pump parameter correction table
500 begin
505 print uniform test image block
510 measure color density distribution
515 calculate pump parameter correction values
520 are all color planes completed?
530 construct pump parameter correction table
540 end

What is claimed is:

1. An image producing apparatus responsive to a stored image file for printing a plurality of microfluidic pixels on a display such as a receiver medium, comprising:

a) a plurality of ink delivery chambers;

b) a plurality of microfluidic pumps, each associated with a particular ink delivery chamber of said plurality of ink delivery chambers;

c) a look-up-table for converting code values corresponding to each pixel of the image file to ink volumes to be pumped into the ink delivery chambers by selected microfluidic pumps;

d) first computing means for computing the ink volumes of ink to be pumped into each ink delivery chamber from the code values of the corresponding pixels of the image file;

e) second computing means responsive to the computed ink volumes for producing pump parameters including pump rate and pump time to compensate for variabilities in the amount of ink delivered by each ink delivery chamber when different pixels are produced; and f) means responsive to the pump parameters for causing the microfluidic pumps to deliver the correct amount of ink into each ink delivery chamber which is compensated for variabilities in each delivery chamber.

2. An image producing apparatus responsive to a stored image file for printing a plurality of microfluidic pixels on a display such as a receiver medium by using cyan, magenta, and yellow inks, comprising:

a) a plurality of ink delivery chambers;

b) a plurality of microfluidic pumps, each associated with a particular ink delivery chamber of said plurality of ink delivery chambers;

c) a look-up-table for converting code values corresponding to each colored pixel of the image file to ink volumes of colored inks to be delivered into each ink delivery chamber by selected microfluidic pumps;

d) first computing means for computing the ink volumes of the inks to be pumped into each ink delivery chamber from the code values of the corresponding pixels of the image file;

e) second computing means responsive to the computed ink volumes for producing pump parameters including pump rate and pump time to compensate for variabilities in the amount of ink delivered by each ink delivery chamber when different pixels are produced; and f) means responsive to the pump parameters for causing the microfluidic pumps to deliver the correct amount of colored ink into each ink delivery chamber which are compensated for variabilities in each delivery chamber.

3. An image producing apparatus responsive to a stored image file for printing a plurality of microfluidic pixels on a display such as a receiver medium by using cyan, magenta, and yellow inks, comprising:

a) a plurality of ink delivery chambers;

b) a plurality of microfluidic pumps, each associated with a particular ink delivery chamber of said plurality of ink delivery chambers;

c) a look-up-table for converting code values corresponding to each colored pixel of the image file to ink volumes of colored inks to be delivered into each ink delivery chamber by selected microfluidic pumps;

d) first computing means for computing the ink volumes of the inks to be pumped into each ink delivery chamber from the code values of the corresponding pixels of the image file;

e) second computing means responsive to the computed ink volumes for producing pump parameters including pump rate and pump time to compensate for variabilities in the amount of ink delivered by each ink delivery chamber when different pixels are produced; and f) means responsive to the pump parameters for causing the microfluidic pumps to deliver the correct amount of colored inks into each ink delivery chamber which are compensated for variabilities in each delivery chamber so that the mixed inks will be transferred to the receiver to form colored image pixels on the receiver representing the image of the image file.

4. The apparatus of claim 3 wherein the inks further include black ink.

5. The apparatus of claim 3 wherein the inks further include colorless ink for mixing with the colored inks to produce continuous tone images.

* * * * *